US010513418B2

(12) United States Patent
Fauconnet et al.

(10) Patent No.: US 10,513,418 B2
(45) Date of Patent: Dec. 24, 2019

(54) APPARATUS AND METHOD FOR ADJUSTING LANDING DOOR LOCKS FROM INSIDE AN ELEVATOR CAR

(71) Applicant: Otis Elevator Company, Farmington, CT (US)

(72) Inventors: Aurelien Fauconnet, Isdes (FR); Amine Badaoui, Briare (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 247 days.

(21) Appl. No.: 15/569,445

(22) PCT Filed: May 6, 2015

(86) PCT No.: PCT/IB2015/000844
§ 371 (c)(1),
(2) Date: Oct. 26, 2017

(87) PCT Pub. No.: WO2016/178047
PCT Pub. Date: Nov. 10, 2016

(65) Prior Publication Data

US 2018/0079621 A1 Mar. 22, 2018

(51) Int. Cl.
*B66B 5/00* (2006.01)

(52) U.S. Cl.
CPC ..... *B66B 5/0087* (2013.01); *Y10T 29/49719* (2015.01)

(58) Field of Classification Search
CPC ..... B66B 5/0087; Y10T 29/49719
See application file for complete search history.

(56) References Cited

U.S. PATENT DOCUMENTS

| | | | | |
|---|---|---|---|---|
| 3,161,964 | A | 12/1964 | Dimmick | |
| 4,733,475 | A | 3/1988 | Youmans | |
| 4,819,403 | A | 4/1989 | Penicaut et al. | |
| 5,433,011 | A | 7/1995 | Scarborough et al. | |
| D399,772 | S | 10/1998 | Sanden | |
| 6,442,857 | B1 | 9/2002 | Atsuhiko et al. | |
| 7,299,590 | B1 * | 11/2007 | Gibbs | E04F 21/0015 248/351 |
| D565,440 | S | 4/2008 | Neal | |

(Continued)

FOREIGN PATENT DOCUMENTS

| | | | |
|---|---|---|---|
| CN | 2182163 | Y | 11/1994 |
| CN | 103659712 | A | 3/2014 |

(Continued)

OTHER PUBLICATIONS

International Search Report, International Application No. PCT/IB2015/000844, dated Jan. 13, 2016, European Patent Office; International Search Report 4 pages.

(Continued)

*Primary Examiner* — Bayan Salone
(74) *Attorney, Agent, or Firm* — Cantor Colburn LLP

(57) ABSTRACT

A tool for adjusting landing door locks in an elevator shaft is provided. The tool includes a first part that is adjustable in length and configured to be mounted in an elevator door opening and a second part movably attached to the first part and configured to simulate an elevator door coupling, the second part moveable along the length of the first part.

12 Claims, 5 Drawing Sheets

(56) References Cited

U.S. PATENT DOCUMENTS

| | | | | |
|---|---|---|---|---|
| 7,753,334 | B2 * | 7/2010 | Schreiber | E04G 21/3261 248/351 |
| 8,407,906 | B2 | 4/2013 | Heyer | |
| 8,622,649 | B1 | 1/2014 | Peeroo et al. | |
| 2003/0033722 | A1 | 2/2003 | Lanham | |
| 2012/0118219 | A1 | 5/2012 | Lindberg et al. | |

FOREIGN PATENT DOCUMENTS

| | | | |
|---|---|---|---|
| CN | 203636733 | U | 6/2014 |
| EP | 1760026 | A1 | 3/2007 |
| FR | 2213220 | A1 | 8/1974 |
| JP | H09132369 | A | 5/1997 |
| JP | 2002234683 | A | 8/2002 |
| JP | 2009263074 | A | 11/2009 |
| JP | 2013129511 | A | 7/2013 |
| WO | 2014122358 | A1 | 8/2014 |
| WO | 2014195565 | A1 | 12/2014 |

OTHER PUBLICATIONS

International Written Opinion, International Application No. PCT/IB2015/000844, dated Jan. 13, 2016, European Patent Office; Written Opinion 6 pages.

* cited by examiner

APPARATUS AND METHOD FOR ADJUSTING LANDING DOOR LOCKS FROM INSIDE AN ELEVATOR CAR

CROSS REFERENCE TO RELATED APPLICATIONS

This is a U.S. National Stage of Application No. PCT/IB32015/000844, filed on May 6, 2015, the disclosure of which is incorporated herein by reference.

BACKGROUND

The subject matter disclosed herein generally relates to elevator cars and, more particularly, to apparatuses and methods of adjusting landing door locks from inside an elevator car.

Current elevator or lift systems, during installation and/or maintenance, may require adjustment of the doors of the cars and/or the doors of the landing floor such that when an elevator car's doors open the landing floor doors will open simultaneously. During operation, when an elevator reaches a landing, a component, such as an elevator car door coupling, of an elevator door will engage with a component of the landing door, such as a landing door lock. The motion for opening and closing doors panels is generated by an elevator car door motor that activates a sliding motion of the elevator car door panels and the landing door panel when the elevator car door coupling is in front of the landing door lock. As such, when the elevator car door opens the landing door will also open. The alignment of these components must be set or adjusted by a technician, mechanic, etc., during installation and/or during maintenance.

Traditionally, car and landing doors are adjusted from the top of car and consequently a safety volume on the top of the car is needed to permit the technician/mechanic to safely work. This adjustment may be done during an installation phase of the elevator and may also be done during maintenance which may be initiated due to wear on the whole elevator system (such as the guidance system) or due to settling of the building. The adjustment may consist of setting the alignment between a car door coupling and a landing door lock at each level having an accuracy close to ±1 mm. This operation is done with both the car doors and the landing doors closed and adjacent or proximal to each other. A technician or mechanic may then access the components of the doors for alignment from the top of car in order to have a direct view of the clearance between the car door coupling and landing door lock.

BRIEF DESCRIPTION

According to one embodiment a tool for adjusting landing door locks in an elevator shaft is provided. The tool includes a first part that is adjustable in length and configured to be mounted in an elevator door opening and a second part movably attached to the first part and configured to simulate an elevator door coupling, the second part moveable along the length of the first part.

In addition to one or more of the features described above, or as an alternative, further embodiments may include that the first part is configured as a telescoping element.

In addition to one or more of the features described above, or as an alternative, further embodiments may include at least one brace attached to an end of the first part, the at least one brace configured to engage with an opening of an elevator door.

In addition to one or more of the features described above, or as an alternative, further embodiments may include that the first part includes a scale configured to enable at least one of (i) adjustment in the length to a desired length and (ii) positioning of the second part.

In addition to one or more of the features described above, or as an alternative, further embodiments may include that the first part includes at least one of a spring biasing mechanism, suction cups, and magnets configured to hold the first part in an opening of an elevator door.

In addition to one or more of the features described above, or as an alternative, further embodiments may include that the tool is configured to be used from the interior of an elevator car.

According to another embodiment, a method of adjusting a landing door lock in an elevator shaft is provided. The method includes opening an elevator door of an elevator car and installing a tool in the opening, the tool having a first part adjustable in length and configured to be mounted in an elevator door opening and a second part movably attached to the first part and configured to simulate an elevator door coupling, the second part moveable along the length of the first part. The method further includes adjusting a position of the second part of the tool to simulate an elevator door coupling of the elevator car in the opening of the elevator car, adjusting a landing door lock relative to the second part of the tool, removing the tool from the opening, and closing the elevator door.

In addition to one or more of the features described above, or as an alternative, further embodiments may include activating a maintenance mode of the elevator car prior to opening the elevator door.

In addition to one or more of the features described above, or as an alternative, further embodiments may include that the maintenance mode is configured to allow the elevator car to be moved within an elevator shaft when the elevator car door is open.

In addition to one or more of the features described above, or as an alternative, further embodiments may include moving the elevator car within an elevator shaft such that the tool may be used to adjust a different landing door lock.

In addition to one or more of the features described above, or as an alternative, further embodiments may include that adjusting a landing door lock is repeated for a plurality of landing door locks.

In addition to one or more of the features described above, or as an alternative, further embodiments may include that the method is performed from the inside of an elevator car.

Technical effects of embodiments described herein include providing tools and methods for adjusting and aligning elevator car doors and landing doors from within an elevator car, eliminating the need for a user, mechanic, technician, etc. to work on top of an elevator car to perform the adjustment. Further technical effects include the potential elimination of additional space required above an elevator car in a hoistway or elevator shaft.

BRIEF DESCRIPTION OF THE DRAWINGS

The subject matter which is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION

During operation of an elevator car within a hoistway or elevator shaft, the car doors of the elevator car and the doors at a landing or floor open simultaneously. When an elevator car reaches a floor or landing, the operation of the elevator car door(s) acts upon the landing door(s), such that both sets of doors open and close together. This is achieved by one or more couplings, such as blades, vanes, etc. installed on the exterior or elevator shaft side of one or more elevator car doors. One or more landing door locks are disposed within the elevator shaft. The landing door lock may be configured as locks, rollers, etc. that are configured to coact with the car door coupling such that the doors operate (open/close) in tandem.

To ensure proper door operation, the coupling of the elevator car and the locks of the landing doors must be aligned. The alignment is necessary so that the doors will operate together when opening and closing. The alignment is also important when an elevator car passes a landing door without stopping. That is, the car door coupling must be able to pass the landing door lock when the elevator car is moving within the elevator shaft without interference or contact between the coupling and the locks.

Figure 1B:
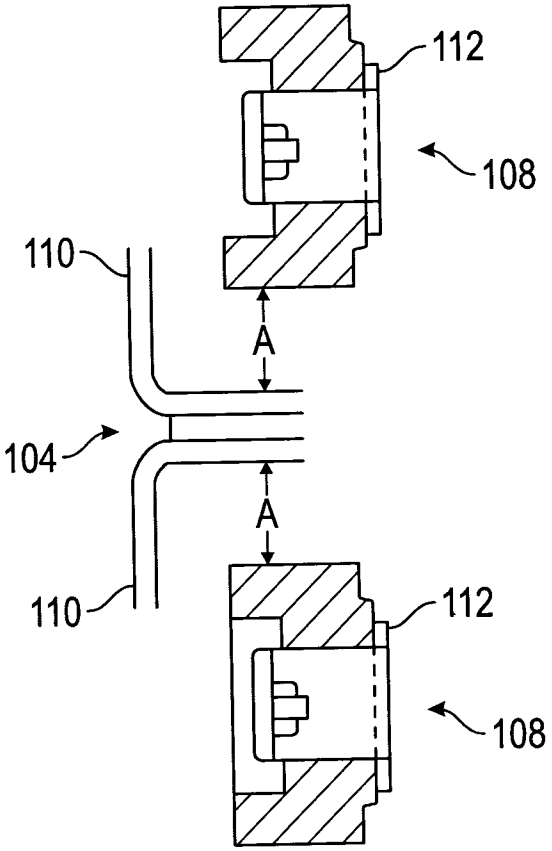
FIG. 1B is an enlarged schematic view of a portion of the elevator car and landing door of FIG. 1A.
Figure 1A:
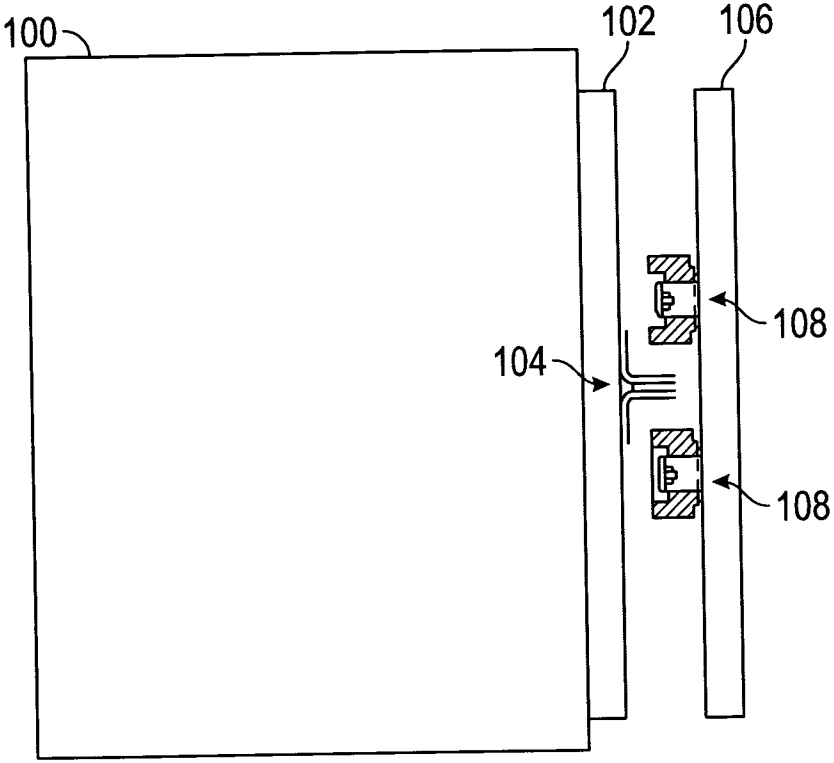
FIG. 1A is a top-down schematic view of an elevator car and landing door.

With reference to FIGS. 1A and 1B, a top down view of an elevator car and landing door is shown. The elevator car 100 has a car door 102 which includes a car door coupling 104. On the landing side there is a landing door 106 and a landing door lock 108. The car door coupling 104 and the landing door lock 108 coact to enable the car door 102 and the landing door 106 to operate simultaneously to open and close. As noted above, the car door coupling 104 and the landing door lock 108 must be aligned for proper operation of the elevator system.

As shown in more detail in FIG. 1B, the car door coupling 104 includes two blades 110 which are disposed between elements 112 of the landing door lock 108, as known in the art. For example, in some embodiments, the landing door lock elements 112 may be configured as two rollers with an adjustable distance between axles made with an eccentric system. As shown, the clearance A between each blade 110 and the adjacent landing door lock element 112 must be adjusted to desired or appropriate clearances for elevator operation. That is, the spacing, i.e., clearance A, must be sufficiently narrow or close for proper engagement during door opening/closing, but must be sufficiently wide or far apart to allow for the blades 110 to pass between the landing door lock elements 112 when the elevator car 100 does not stop at the particular landing door 106.

Figure 2A:
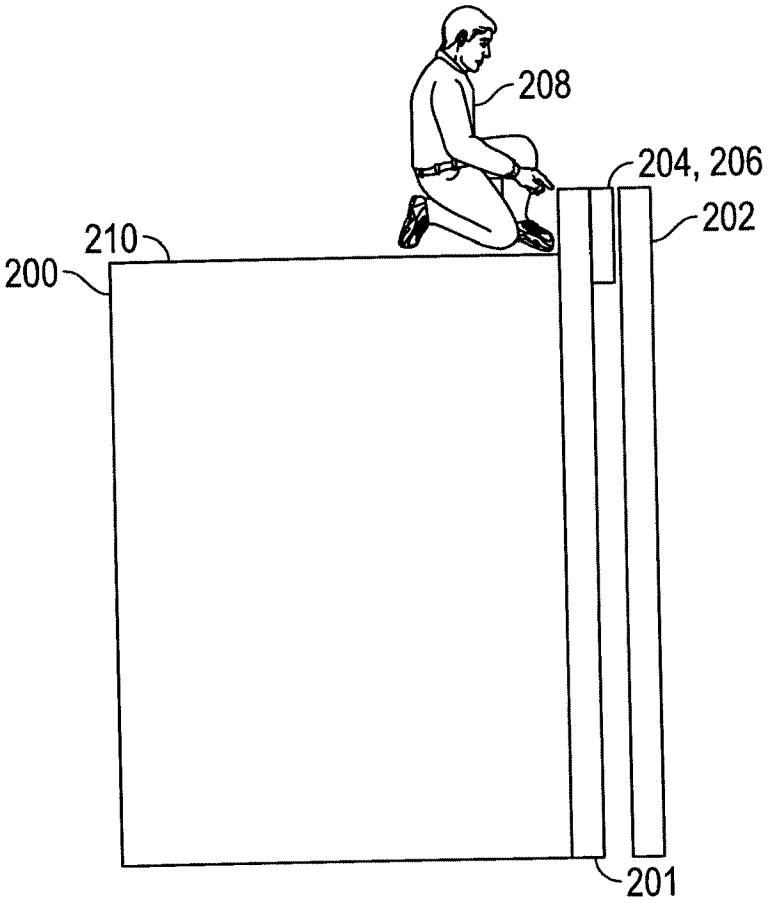
FIG. 2A is a schematic side view of a traditional operation performed during alignment and adjustment of elevator car door coupling and landing door lock.
Figure 2B:
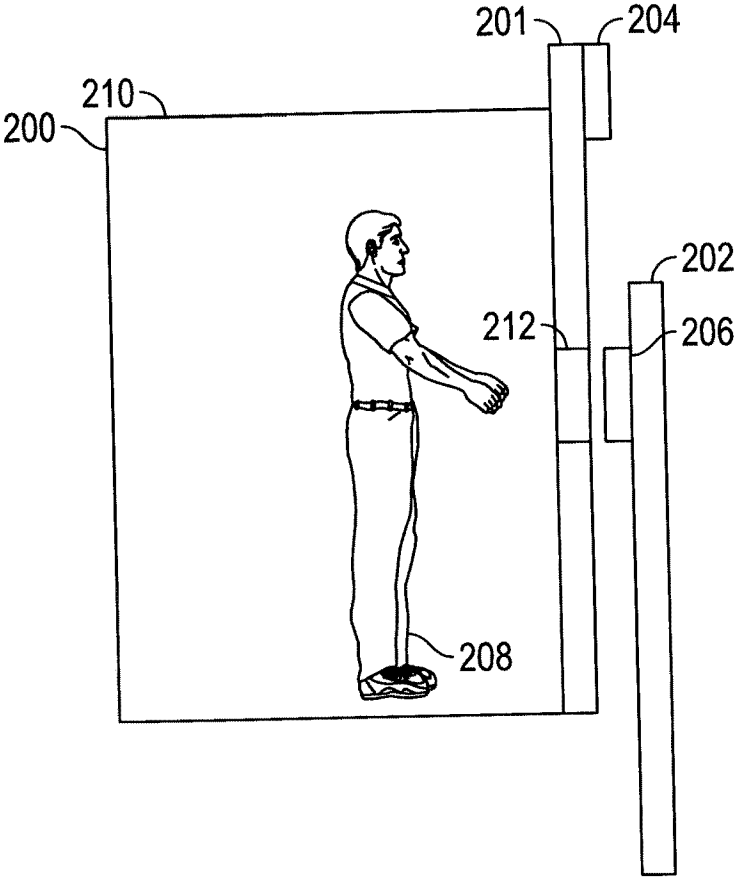
FIG. 2B is a schematic side view of an operation performed in accordance with an exemplary embodiment of the disclosure.

Referring now to FIGS. 2A and 2B, side view schematic illustrations of the adjustment of an elevator door coupling is shown. FIG. 2A shows an elevator car 200 having a car door 201 relative to a landing door 202 as configured during normal operation and indicating the traditional method of adjusting the couplings. FIG. 2B shows an exemplary configuration of the disclosure, illustrating a user adjusting a landing door lock from inside the elevator car 200. Traditionally, as shown in FIG. 2A, the adjustment of the couplings was made from on top of the elevator car 200 where a user could visibly see and physically access a car door coupling 204 and a landing door lock 206 at the same time. That is, the user would access the car door coupling 204 and the landing door lock 206 when the two elements were near or proximal to each other, i.e., in positions that approximate or represent operational positions of the doors.

As such, under prior processes, a user 208 would be located on the top 210 of the elevator car 200, where the car door coupling 204 and the landing door lock 206 are located such that any adjustments may be made to the landing door lock 206 relative to the car door coupling 204. After an adjustment process, the user 208 would then have to get off the top 210 of the elevator car 200 or operate the elevator car 200 in an inspection mode to move the elevator car 200 to another landing to perform a second adjustment at the second landing, and this would be repeated for each floor/landing of an elevator shaft.

However, as shown in FIG. 2B, such a process is not necessary when embodiments of the disclosure are employed. The user 208 may access and perform an alignment procedure on the landing door lock 206 from within the elevator car 200. As shown, in contrast to FIG. 2A, the car door coupling 204 is not proximal to the landing door lock 206. Instead, a tool 212 is used by the user 208 to represent the location of the car door coupling 204 from within the elevator car 200. As such, the elevator car 200 is located offset from the landing door 202, where the user 208 can easily access the top of the landing door 202 where the landing door lock 206 is located. As such, the user 208 does not need to be located on the top of the elevator car 200 to perform the alignment between the car door coupling 204 and the landing door lock 206.

Figure 3C:
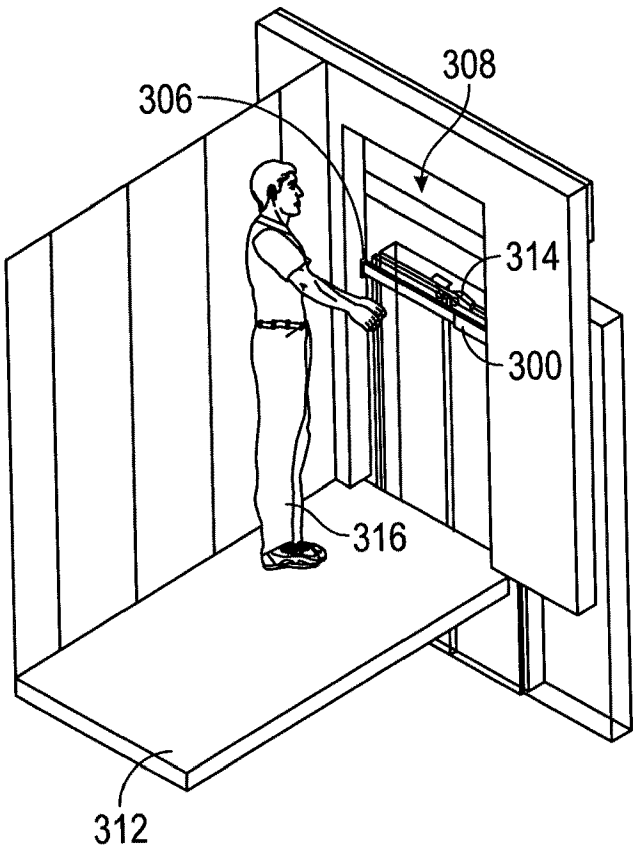
FIG. 3C is a schematic view of the tool of FIG. 3A as installed in an elevator car.
Figure 3A:
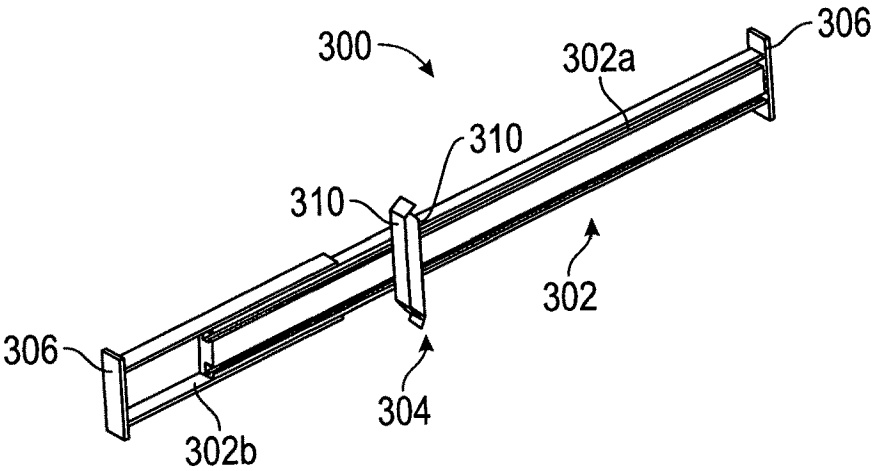
FIG. 3A is a perspective view of a tool in accordance with an exemplary embodiment of the disclosure.
Figure 3B:
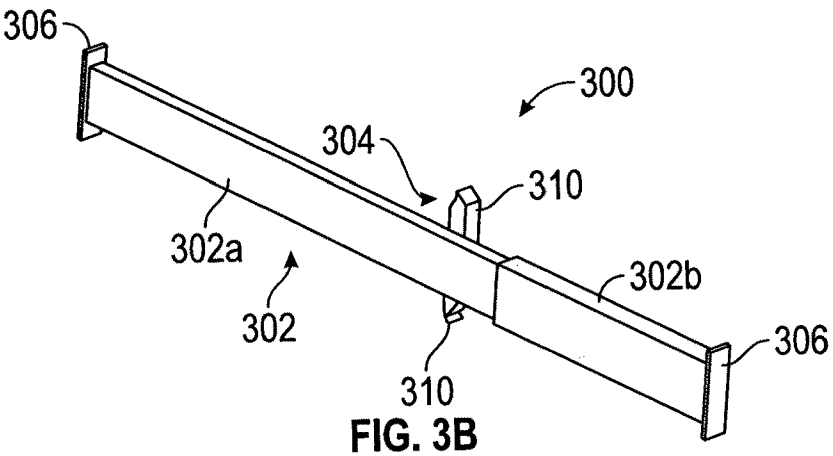
FIG. 3B is an alternative perspective of the tool of FIG. 3A.

Turning now to FIGS. 3A-3C, perspective views of a tool 300 in accordance with an exemplary embodiment of the disclosure are shown in FIGS. 3A and 3B, and FIG. 3C shows a schematic illustration of the tool 300 installed for use. Tool 300 includes a first part 302 and a second part 304. The first part 302 is configured to be adjustable and/or telescoping such that a length of the first part 302 may be adjusted. The first part 302 is formed from two elements 302*a*, 302*b* that are configured to adjust relative to each other, allowing for adjustment in a length of the first part 302. Optional braces 306 are located at each end of the two elements 302*a*, 302*b* of the first part 302. The braces 306 are configured to enable the tool 300 to be installed in an elevator car door opening 308 (see FIG. 3C).

The second part 304 is configured to simulate a coupling for an elevator car door. As such, the second part 304 is configured as one or more blades 310. The second part 304 is adjustable and/or moveable along the length of the first part 302. Thus, the second part 304 may be located or adjusted to be located at the precise horizontal location of the car door coupling but located in the elevator car door opening 308 of the elevator car 312, rather than at the top of the elevator car.

The adjustability of the first part 302 enables the tool 300 to be fit within any width elevator car door opening 308. For example, the tool 300 may be collapsed to a first length, positioned at a desired height within an elevator car door opening, and then lengthened by telescoping action to fit within the opening of the elevator car door. The braces 306 are configured to engage and/or support the tool 300 in the proper position. Once the first part 302 is engaged within the elevator car door opening 308, the second part 304 may be adjusted to the proper position to represent where the elevator car door coupling would be located when the elevator car doors are closed. This position may be determined based on a measurement from the edge of the opening 308, or based on some other measurement or positioning mechanism or process. In some embodiments, the first part 302 may include distance or length indicators marked thereon to assist and ensure proper location and placement of the second part 304 within the opening 308.

Once the second part 304 is positioned to simulate the elevator door coupling, the elevator car 312 may be moved vertically within an elevator shaft to position the second part 304 relative to a landing door lock 314. Once positioned, a user 316 may perform an adjustment operation, as described above, to ensure a proper clearance between the second part 304 and the landing door lock 314, which in turn ensures a proper clearance between the landing door lock 314 and the elevator car door coupling (not shown) that is on the elevator car door.

Figure 4A:
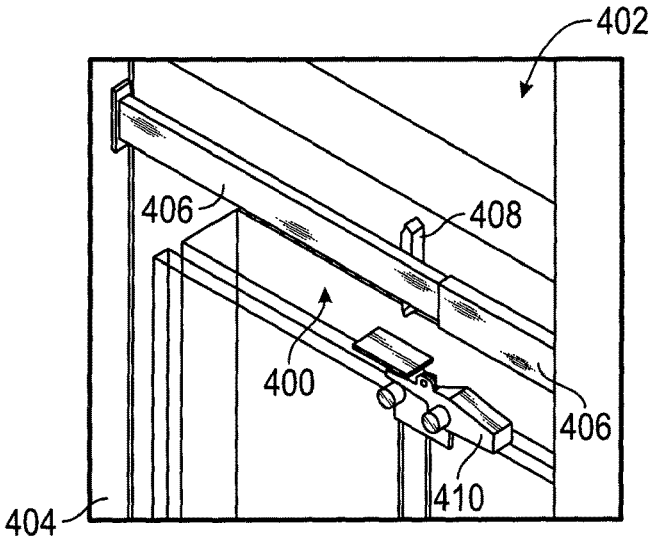
FIG. 4A is a schematic view of a step of a process of using a tool in accordance with an exemplary embodiment of the disclosure.
Figure 4B:
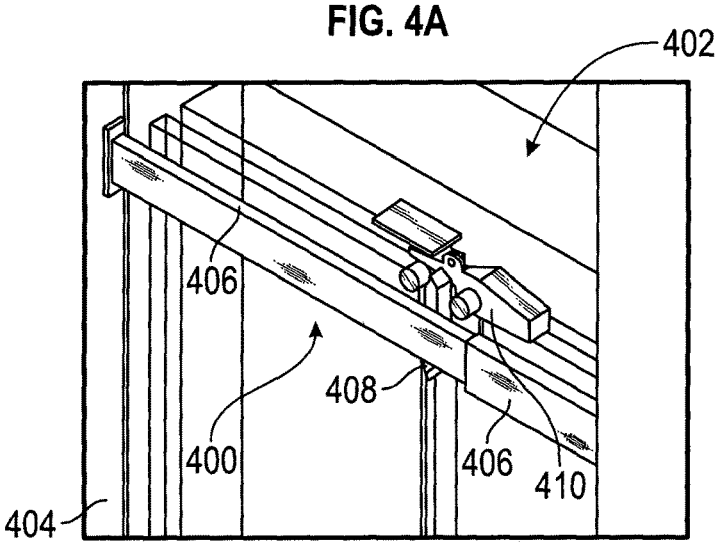
FIG. 4B is a second view of a step of using the tool of FIG. 4A.
Figure 4C:
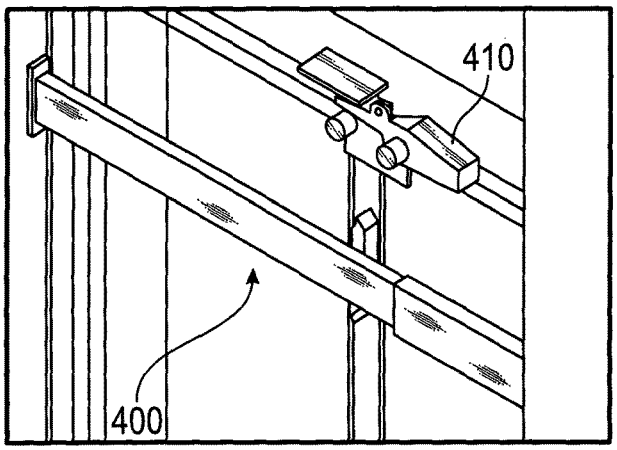
FIG. 4C is a third view of a step of using the tool of FIG. 4A.

Turning now to FIGS. 4A-4C, an enlarged view of the process described above is shown. In FIGS. 4A-4C a tool in accordance with an exemplary embodiment of the disclosure is shown installed within an elevator car door opening and relative to a landing door lock.

In FIG. 4A, a tool 400 is installed in an opening 402 of an elevator car 404. FIG. 4A shows a first part 406 of the tool 400 that is adjustable and installed between portions of the elevator car 404. A second part 408 is located and positioned to represent where the elevator car door coupling would be located if the elevator car doors were closed. Thus, the tool 400 simulates the elevator car door coupling.

Once located as desired, the elevator car 404 may be moved vertically up or down, such that the second part 408 of the tool 400 is located proximate to a landing door lock 410, as shown in FIG. 4B. In the position shown in FIG. 4B, the landing door lock 410 may be adjusted to set the desired clearance between the elements of the landing door lock 410 and the second part 408 of tool 400. Because the tool 400 simulates the elevator car door coupling, the elements of the landing door lock 410 are also set or aligned with the desired clearance with respect to the elevator car door coupling.

After the landing door lock 410 is adjusted to set the desired clearance, the elevator car 404 may be moved vertically again to enable adjustment of a different landing door lock at a different landing or floor. As shown in FIG. 4C, the tool 400 is moved relative to the landing door lock 410. During this movement, the tool 400 may be held within the opening 402 by the first part 406, and the elevator car 404 may be moved between floors. That is, the tool 400 does not need to be removed when moving between floors.

Figure 5:
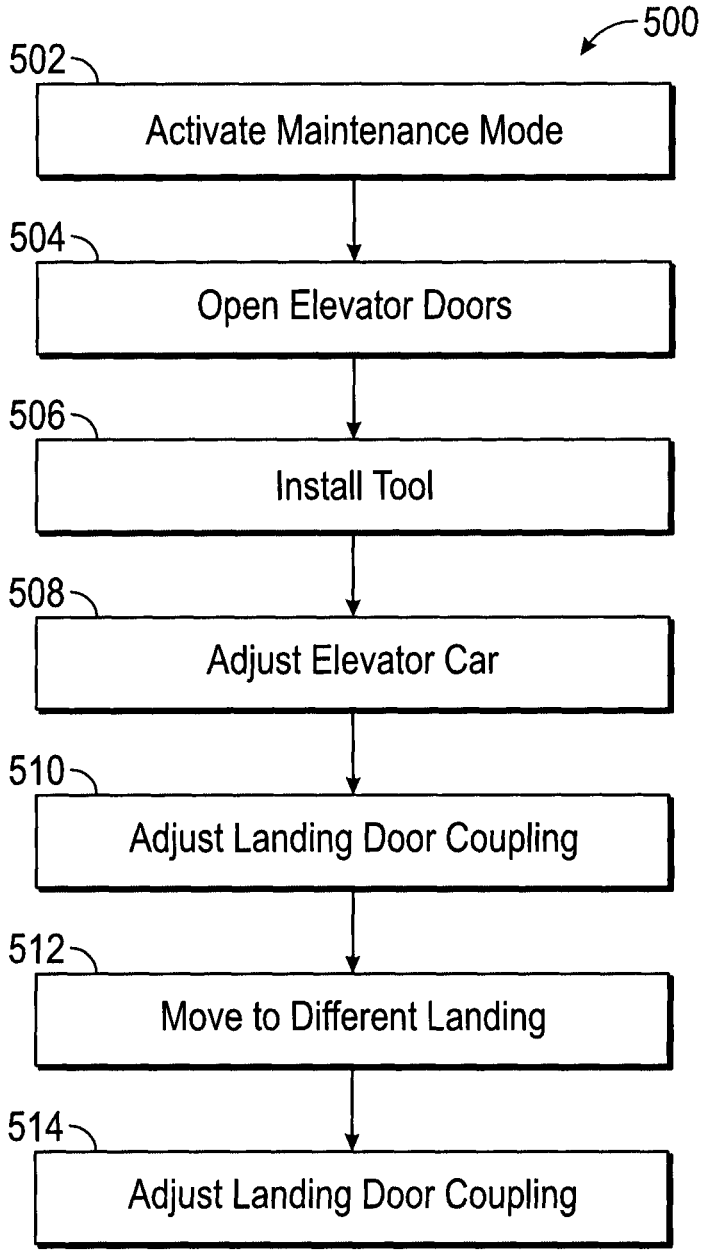
FIG. 5 is a process of adjusting a landing door lock in accordance with an exemplary embodiment of the disclosure.

Turning now to FIG. 5, a process for adjusting and aligning landing door locks in an elevator shaft is shown. Process 500 employs a tool similar to that described above. At step 502 a maintenance mode of an elevator may be activated. The maintenance mode may be configured to allow for the elevator car to be moved within the elevator shaft, between various floors or landings, even when the elevator car doors are open. The maintenance mode may be activated from inside the elevator car, such as at an operating panel. In such embodiments, the movement of the elevator car with the doors open may be by operation of the buttons that direct the elevator car to various floors during normal operation.

Once in maintenance mode, at step 504, the elevator car doors may be opened, exposing the interior of the elevator shaft, and providing access to the landing doors within the elevator shaft and from the interior of the elevator car. As noted, a maintenance mode, as activated in step 502, may enable the elevator car to be moved within an elevator shaft even when the elevator car door is open.

At step 506, a tool, as described above, may be installed into the opening of the elevator car door. The installation process may include adjusting a length of the tool such that it may be securely retained or held in the elevator car door opening. Further, the installation process may include adjusting a part of the tool that simulates the elevator car door coupling to a location that represents the location of the elevator car door coupling when the elevator car doors are closed.

At step 508, the elevator car may be adjusted or moved within the elevator shaft to a position to locate the tool adjacent to or level with the landing door lock. This may involve having the elevator car move vertically within the elevator shaft, either upward or downward to position the tool as desired.

At step 510, the landing door lock may be adjusted and aligned. The adjustment may involve adjusting the clearance of elements of the landing door lock relative to a portion of the tool, as described above. The clearance may be adjusted to a predetermined or desired clearance. Once the clearance is set at step 510, the landing door lock will be configured to allow an elevator door coupling to pass by the landing door lock when the elevator is moving within the elevator shaft. Further, the configuration and clearance may be set to allow for proper operation of the landing door in tandem with the elevator door, for example, when in normal operation of the elevator.

At step 512, the elevator car may then be moved to a different landing within the elevator shaft. As will be apparent, there is no adjustment or change of the setting(s) of the tool. As such, the tool may only need to be installed and calibrated once for adjustments to be made to a plurality of landing door locks. At step 514, a different landing door lock may be adjusted and aligned. The process may be repeated any number of times.

Once all necessary or desired adjustments are complete, the tool may be removed from the opening, the elevator doors closed, and the elevator may be switched back into normal operating mode. It will be appreciated by those of skill in the art that the maintenance mode of the elevator may be implemented by a software or electrical control that is configured to enable the elevator door(s) to remain open, even when the elevator car is moving within the elevator shaft. The maintenance mode may be activated by a computer, by a key switch, or other mechanism known in the art.

Advantageously, embodiments of the disclosure provide a tool to allow for adjustment and alignment of a landing door lock of an elevator system from the interior of the elevator car. Further, advantageously, safety of a user such as a mechanic, technician, etc. may be improved by use of various embodiments of the disclosure, because the user may not need to be physically located on top of the elevator car, but rather located within the elevator car.

Further, advantageously, embodiments of the disclosure provide a tool for accurate adjustment and alignment of elevator car door couplings and landing door locks. Moreover, embodiments of the disclosure allow for adjustment of a plurality of landing door locks, without the need to make adjustments to the tool. That is, advantageously, the time to adjust a number of landing door locks is reduced due to the ability to set the tool only once, and then move the elevator car between landings, without adjusting the tool.

While the disclosure has been described in detail in connection with only a limited number of embodiments, it should be readily understood that the disclosure is not limited to such disclosed embodiments. Rather, the embodiments of the disclosure can be modified to incorporate any number of variations, alterations, substitutions, combinations, sub-combinations, or equivalent arrangements not heretofore described, but which are commensurate with the spirit and scope of the disclosure. Additionally, while various embodiments of the disclosure have been described, it is to be understood that aspects of the disclosure may include only some of the described embodiments.

For example, although described and shown herein with a limited number of configurations, the shape, length, dimensions, etc. of the tool may be varied without departing from the scope of the disclosure. For example, the tool may be cylindrical or have other geometry. Further, the tool may be spring biased, employ suction cups or similar mechanisms, and/or employ magnetics to enable the tool to be secured to the opening of the elevator door. Other configurations are possible, such as peg-and-hole configurations for adjusting the length and/or other dimensions of the tool, and locking the tool at a desired length.

Accordingly, the disclosure is not to be seen as limited by the foregoing description, but is only limited by the scope of the appended claims.

What is claimed is:

1. A tool for adjusting landing door locks in an elevator shaft, the tool comprising:

a first part that is adjustable in length and configured to be mounted in an elevator door opening; and a second part movably attached to the first part and configured to simulate an elevator door coupling, the second part moveable along the length of the first part.

2. The tool of claim 1, wherein the first part is configured as a telescoping element.

3. The tool of claim 1, further comprising at least one brace attached to an end of the first part, the at least one brace configured to engage with an opening of an elevator door.

4. The tool of claim 1, wherein the first part includes a scale configured to enable at least one of (i) adjustment in the length to a desired length and (ii) positioning of the second part.

5. The tool of claim 1, wherein the first part includes at least one of a spring biasing mechanism, suction cups, and magnets configured to hold the first part in an opening of an elevator door.

6. The tool of claim 1, wherein the tool is configured to be used from the interior of an elevator car.

7. A method of adjusting a landing door lock in an elevator shaft, the method comprising:

opening an elevator door of an elevator car;

installing a tool in the opening, the tool having a first part adjustable in length and configured to be mounted in an elevator door opening and a second part movably attached to the first part and configured to simulate an elevator door coupling, the second part moveable along the length of the first part;

adjusting a position of the second part of the tool to simulate an elevator door coupling of the elevator car in the opening of the elevator car;

adjusting a landing door lock relative to the second part of the tool;

removing the tool from the opening; and closing the elevator door.

8. The method of claim 7, further comprising activating a maintenance mode of the elevator car prior to opening the elevator door.

9. The method of claim 8, wherein the maintenance mode is configured to allow the elevator car to be moved within an elevator shaft when the elevator car door is open.

10. The method of claim 7, further comprising moving the elevator car within an elevator shaft such that the tool may be used to adjust a different landing door lock.

11. The method of claim 7, wherein adjusting a landing door lock is repeated for a plurality of landing door locks.

12. The method of claim 7, wherein the method is performed from the inside of an elevator car.

* * * * *